US010458696B1

(12) United States Patent
Matusiak et al.

(10) Patent No.: US 10,458,696 B1
(45) Date of Patent: Oct. 29, 2019

(54) OPENING SYSTEM FOR A STORAGE BIN ASSEMBLY

(71) Applicant: WHIRLPOOL CORPORATION, Benton Harbor, MI (US)

(72) Inventors: Szymon Matusiak, Wroclaw (PL); Krzysztof Krawczyk, Kielczow (PL); Giuseppina Arresta, Ternate (IT); Maurizio Valle, Varese (IT); Christine Nortey, Milan (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/945,315

(22) Filed: Apr. 4, 2018

(51) Int. Cl.

| | |
|---|---|
| ***F25D 23/04*** | (2006.01) |
| ***F25D 25/00*** | (2006.01) |
| ***E06B 5/00*** | (2006.01) |
| ***E06B 3/38*** | (2006.01) |

(52) U.S. Cl.
CPC ..... *F25D 23/04* (2013.01); *F25D 25/005* (2013.01); *E06B 3/38* (2013.01); *E06B 5/00* (2013.01)

(58) Field of Classification Search
CPC ..... F25D 23/025; F25D 23/04; F25D 25/005; E06B 5/00; E06B 3/38
See application file for complete search history.

(56) References Cited

U.S. PATENT DOCUMENTS

| | | | | |
|---|---|---|---|---|
| 2,317,212 | A | 4/1943 | Newman | |
| 2,322,769 | A | 6/1943 | Norberg | |
| 2,828,178 | A | 3/1958 | Dahlgreen | |
| 8,152,257 | B2 * | 4/2012 | Kim | F25D 23/04 312/405.1 |
| 9,097,457 | B2 * | 8/2015 | Kim | F25D 23/028 |
| 9,738,425 | B2 | 8/2017 | Shrader et al. | |
| 2009/0277209 | A1 * | 11/2009 | Jang | F25D 11/006 62/441 |
| 2010/0270902 | A1 * | 10/2010 | Kim | F25D 17/042 312/405.1 |
| 2017/0367478 | A1 * | 12/2017 | Ahmedov | A47B 57/58 |

FOREIGN PATENT DOCUMENTS

| | | | | |
|---|---|---|---|---|
| DE | 3446194 | C1 | 2/1986 | |
| DE | 102008061231 | A1 * | 7/2009 | F25D 23/04 |
| DE | 102011075561 | A1 * | 11/2012 | F25D 23/04 |
| DE | 102011075561 | A1 | 11/2012 | |
| EP | 2131125 | A2 * | 12/2009 | F25D 23/025 |
| EP | 2299217 | A2 | 8/2010 | |
| EP | 2778579 | A1 * | 9/2014 | F25D 23/04 |
| GB | 1012734 | | 12/1965 | |
| JP | 2005217315 | A * | 8/2005 | |

* cited by examiner

*Primary Examiner* — Andrew M Roersma
(74) *Attorney, Agent, or Firm* — Price Heneveld LLP

(57) ABSTRACT

A storage bin assembly for a refrigerator is provided. The storage bin assembly includes a base portion having opposed outer end sidewalls upwardly extending from the base portion. A flap is pivotally coupled to the opposed outer end sidewalls where the flap is configured to rotate between a closed position and an open position where the flap is positioned beneath the base portion. A top cover is coupled to a receiving slot portion of the opposing outer end sidewalls where a first magnetic member is positioned in a holding member proximate the top cover. A second magnetic member positioned in a receiving member of the flap that selectively engages the first magnetic member to define a magnetic connection.

17 Claims, 10 Drawing Sheets

OPENING SYSTEM FOR A STORAGE BIN ASSEMBLY

FIELD OF THE DISCLOSURE

The present device generally relates to a storage bin assembly for a refrigerator, and more specifically, to a storage bin assembly having a magnetic opening and closing system.

BACKGROUND

Refrigerators may be provided with several different compartments, and some of these compartments can be supported from a door of the refrigerator. Refrigerator door bins are generally known and can include a bin unit configured for removable assembly with a liner of the refrigerator door. The configuration of the bin unit separate from the liner is generally a product of the material and process limitations associated with the liner, which is usually formed using a vacuum-forming process. The bin unit is generally more suitable for an injection molding or similar process. Accordingly, the bin unit and liner are often separately made and must be assembled together. Most assemblies facilitate selective placement of the bin within a number of available positions on a refrigerator door. Such known assemblies may provide weak attachment between the bin unit and the associated liner of the door, requiring additional fixation (such as the taping of adjacent components) during shipping. Beyond transportation and assembly issues, it is desired to provide a storage bin having an opening and closing mechanism that is convenient for the consumer while still providing efficient use of storage space defined by the refrigeration compartment.

SUMMARY

According to one aspect of the present disclosure, a storage bin assembly for a refrigerator is provided. The storage bin assembly includes a base portion having opposed outer end sidewalls upwardly extending from the base portion; a flap pivotably coupled to the opposed outer end sidewalls wherein the flap is configured to rotate between a closed position and an open position where the flap is positioned beneath the base portion; a top cover coupled to a receiving slot portion of the opposed outer end sidewalls where a first magnetic member is positioned in a holding member proximate the top cover; and a second magnetic member positioned in a receiving member of the flap that selectively engages the first magnetic member to define a magnetic connection.

According to another aspect of the present disclosure, a refrigerator door is provided. The refrigerator door includes a liner disposed on an inner portion of the door, the liner including opposed outwardly extending sidewalls that are spaced apart from one another, having outwardly extending coupling features disposed on inner surfaces of each opposed sidewall; and a storage bin assembly. The storage bin assembly includes: a base portion having opposed outer end sidewalls upwardly extending from the base portion; a flap pivotably coupled to the opposed outer end sidewalls wherein the flap is configured to rotate between a closed position and an open position where the flap is positioned beneath the base portion; a top cover coupled to a receiving slot portion of the opposed outer end sidewalls where a first magnetic member is positioned in a holding member proximate the top cover; and a second magnetic member positioned in a receiving member of the flap that selectively engages the first magnetic member to define a magnetic connection.

According to yet another aspect of the present disclosure, a refrigerator is provided. The refrigerator includes a door; a liner disposed on an inner portion of the door, the liner including opposed outwardly extending sidewalls that are spaced apart from one another, having outwardly extending coupling features disposed on inner surfaces of each opposed sidewall; and a storage bin assembly. The storage bin assembly includes: a base portion having opposed outer end sidewalls upwardly extending from the base portion; a flap pivotably coupled to the opposed outer end sidewalls wherein the flap is configured to rotate between a closed position and an open position where the flap is positioned beneath the base portion; a top cover coupled to a receiving slot portion of the opposed outer end sidewalls where a first magnetic member is positioned in a holding member proximate the top cover; a second magnetic member positioned in a receiving member of the flap that selectively engages the first magnetic member to define a magnetic connection.

These and other features, advantages, and objects of the present device will be further understood and appreciated by those skilled in the art upon studying the following specification, claims, and appended drawings.

DETAILED DESCRIPTION OF EMBODIMENTS

Figure 1:
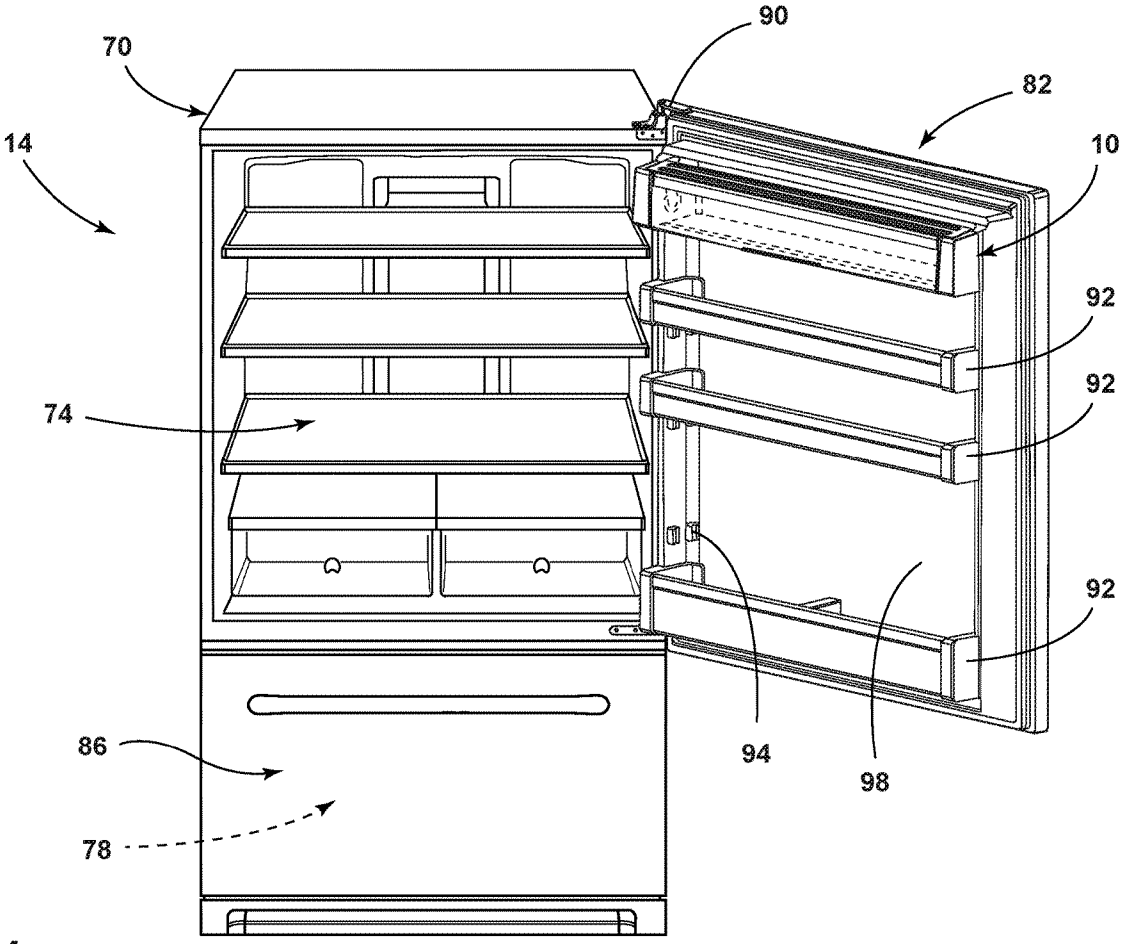
FIG. 1 is a front isometric view of a refrigerator according to one aspect of the present disclosure.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

Referring to FIGS. 1-6C, the reference numeral 10 refers to a storage bin assembly for a refrigerator 14. The storage bin assembly 10 includes a base portion 18 having opposed outer end sidewalls 22 upwardly extending from the base portion 18. A flap 26 is pivotally coupled to the opposed outer end sidewalls 22 where the flap 26 is configured to rotate between a closed position 30 and an open position 34. In the open position 34, the flap 26 is positioned beneath the base portion 18. A top cover 38 is coupled to a receiving slot portion 42 of the opposing outer end sidewalls 22 where a first magnetic member 46 is positioned in a holding member 50 proximate the top cover 38. A second magnetic member 54 is positioned in a receiving member 58 of the flap 26 that selectively engages the first magnetic member 46 to define a magnetic connection.

Referring now to FIG. 1, the refrigerator 14 is shown having a cabinet 70 with a refrigeration compartment 74 and a freezer compartment 78 enclosed by a refrigerator door 82 and a freezer door 86, respectively. The refrigerator and freezer compartments 74, 78 are selectively accessible via the refrigerator and freezer doors 82, 86 that are pivotally coupled to the cabinet 70 at a hinge 90. The refrigerator door 82 includes a plurality of bin assemblies 92 connected using coupling features 94 disposed on opposing sidewalls of a door liner 98. The refrigerator door 82 additionally includes the storage bin assembly 10 removably coupled to the door liner 98 of the refrigerator door 82 through coupling features 94.

Figure 2C:
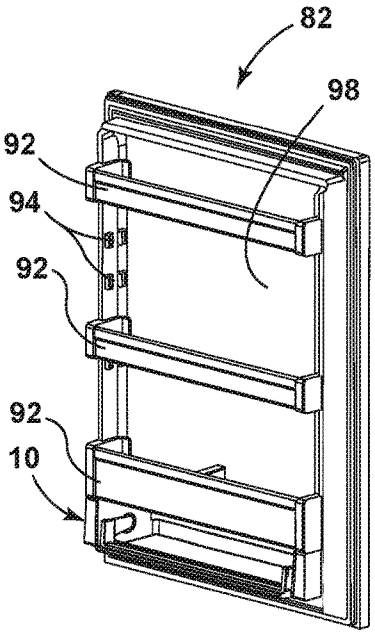
FIGS. 2A-2C are isolated rear isometric views of a refrigerator door having an inventive storage bin assembly positioned in a variety of different locations.
Figure 2B:
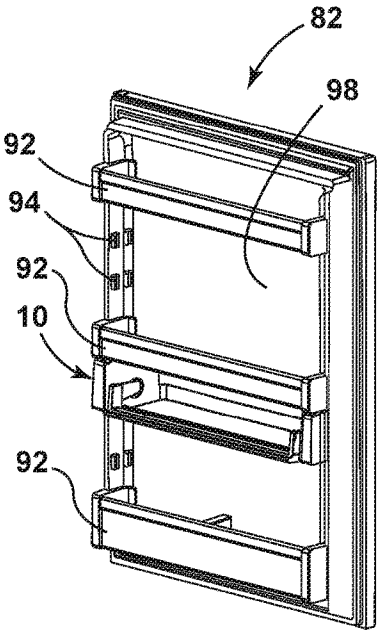
Figure 2A:
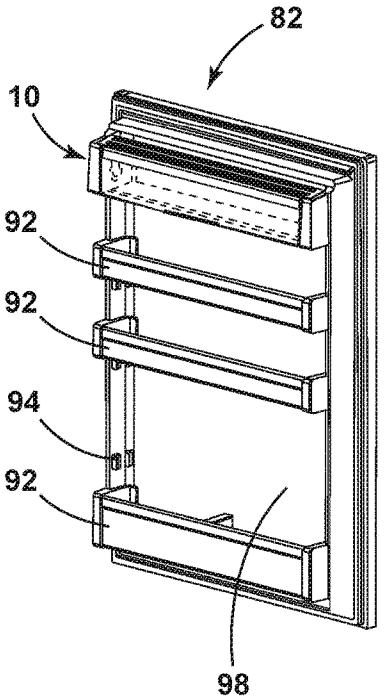

Referring now to FIGS. 2A-2C, the storage bin assembly 10 is configured to be removably attached to coupling features 94 positioned or formed into the door liner 98 of the refrigerator door 82. The positioning of the storage bin assembly 10 on the door liner 98 may vary as desired by the user to take advantage of access requirements and storage needs. For example, in FIG. 2A, the storage bin assembly 10 is positioned in the closed position 30 (FIG. 4A) at the highest coupling point on the refrigerator door 82. In this position, the contents of the storage bin assembly 10 may be kept out of reach of animals or children. Alternatively, in FIG. 2B, the storage bin assembly 10 is positioned in the open position 34 (FIG. 4C) in the middle of the door 82. The ability of the user to strategically position the storage bin assembly 10 anywhere along the inside of the refrigerator door 82 is advantageous since accessibility can be managed for children or people having different restrictions in being able to access the storage bin assembly 10 and/or bin assemblies 92 of the refrigerator door 82. The number of storage bin assemblies 10 is not meant to be limiting and in some embodiments, the refrigerator door 82 may include one, two, three, or more storage bin assemblies 10. Lastly, FIG. 2C illustrates the storage bin assembly 10 in the open position 34 where the storage bin assembly 10 is positioned in the lowermost position on the refrigerator door 82. In this position, the contents of the storage bin assembly 10 may be accessible to the reach of animals or children. In some aspects as illustrated in FIGS. 2B and 2C, the storage bin assembly 10 may be positioned in a slot on the refrigerator door 82 beneath another bin assembly 92 or bottle bin where the flap 26 is folded and/or rotated down beneath the base portion 18, uninhibited by the bin assembly 92 or bottle bin positioned directly above the storage bin assembly 10.

Figure 3:
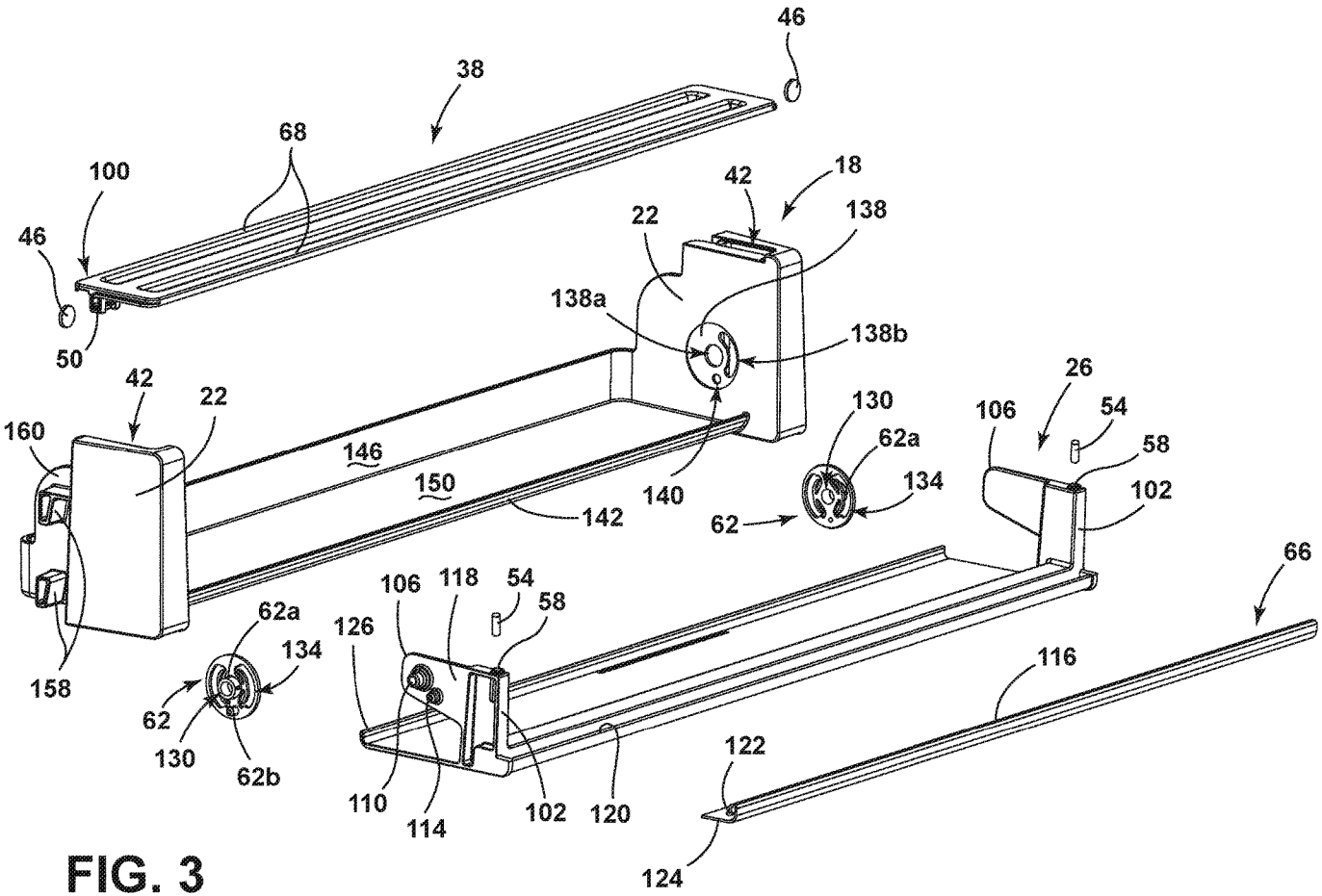
FIG. 3 is an exploded front isometric view of a storage bin assembly according to one aspect of the present disclosure.

Referring now to FIG. 3, an exploded view of the storage bin assembly 10 is provided. The core features of the storage bin assembly 10 include the base portion 18, the flap 26, and the top cover 38. The enclosed first magnetic member 46 and second magnetic member 54 are used to form an opening/closing assembly or system used to close the flap 26 of the storage bin assembly 10 to be in contact with a rear portion 100 of the top cover 38. The flap 26 includes a hinge arm 102 positioned at each end of the flap 26 where each of the hinge arms 102 include an arm flap 106 extending down from each hinge arm 102. In some aspects, the arm flaps 106 can be flattened pieces of material relative to the hinge arm 102 that are positioned to be aligned parallel with respect to the inner surface of the outer end sidewalls 22. Each of the arm flaps 106 may include a pivot member 110 and a boss 114 positioned on an outer flap surface 118 of the arm flap 106.

Still referring to FIG. 3, the flap 26 further includes an edge portion 120 used to couple a profile buffer strip 66 using a clip member 122 formed onto a profile wall 124 of the profile strip 66. On the opposite end of the flap 26 is a curved flange member 126 positioned along the length of a bottom edge of the flap 26. In some aspects, the curved flange member 126 may be used in the upper closed and/or open positions 30, 34 to help stabilize the flap 26 by helping eliminate twisting or lateral movement. One or more second magnetic members 54 may be inserted into the receiving member 58 of the flap 26. The second magnetic member 54 is shown as a cylinder but the form is not meant to be limiting and may include, for example, disk, cube, wire, egg shape, flat, sphere, and/or horseshoe magnets. The receiving member 58 may have its shape and dimensions varied to position and hold the second magnetic member 54 regardless of its shape. In some aspects, the profile strip 66 is configured to cover an edge portion 120 of the flap 26 to form a seal against the base portion 18 and top cover 38 using a sealing edge 116 when the flap 26 is set in the closed position 30. The first magnetic member 46 is positioned in the holding member 50.

The positioning and design of the respective holding members 50 and receiving members 58 may be varied depending on the end use and desired functionality of the storage bin assembly 10. For example, the first magnetic member 46 may be positioned in the holding member 50 proximate the top cover 38. In some aspects, "proximate the top cover 38" may include the holding member 50 coupled to the top cover 38, the opposed outer end sidewalls 22, or a combination thereof. In other aspects, the holding member 50 may be coupled to the opposed outer end sidewalls 22, the top cover 38, the lip 142, the back wall 146, the floor 150, or a combination thereof. In still other aspects, the holding member 50 may be coupled to the top cover 38. The second magnetic member 54 may be positioned in the receiving member 58 of the flap 26. The positioning of the receiving member 58 on or in the flap 26 may be varied as required to form the magnetic connection between the first magnetic member 46 positioned in the opposed outer end sidewalls 22, the top cover 38, the back wall 146, the floor 150, or combinations thereof and the second magnetic member 54.

The pivot member 110 and the boss 114 positioned on the respective arm flaps 106 of the flap 26 are configured to be positioned in a center cutout 130 and/or a rotational cutout 134, respectively, of a bumper insert 62. The bumper insert 62 is positioned in a rotational guide 138 imprinted or cut into an inner portion of the outer end sidewalls 22 of the base portion 18, more specifically, a center cutout tab 62*a* and a bumper insert positioning tab 62*b* are positioned in a center guide 138*a* and a sidewall locking guide 140, respectively, on the outer end sidewalls 22. The rotational cutouts 134 are aligned with and overlap a sidewall rotational guide 138*b*. The flap 26 can then be rotated using the pivot member 110 as the positioning element for the flap 26 and the boss 114 can be rotationally guided through both the rotational cutout 134 and the sidewall rotational guide 138*b*. In some aspects, the bumper insert 62 is positioned in each of the opposed outer end sidewalls 22 wherein the bumper insert 62 includes the rotational cutout 134 used to direct rotation of the flap 26. The storage bin assembly 10 includes the flap 26 having two hinge arms 102 with the pivot member 110 and the boss 114 coupled to the bumper insert 62 positioned in the rotational guide 138.

The base portion 18 includes a lip 142 opposing a back wall 146 that together in combination with the outer end sidewalls 22 frame in a floor 150 of the base portion 18. The lip 142, back wall 146, outer end sidewalls 22, and floor 150 form a sealed off portion where spilled fluids or other food stuffs can be contained without leaking out of the storage bin assembly 10. The two outer end sidewalls 22 include the receiving slot portion 42 configured to position the top cover 38 therein so both the top portions of the top cover 38 and outer end sidewalls 22 are level with each other to form a flat top surface on the top cover 38 for the storage bin member 10. In some aspects, the top cover 38 may include one or more ridges 68 molded or carved into a top portion. In such aspects, the one or more ridges 68 may form a textured surface to grip foodstuffs positioned on the top portion of the top cover 38.

The outer end sidewalls 22 of the base portion 18 further include two or more bin supports 158 molded or coupled to a recessed support wall 160 formed on both of the outer end sidewalls 22. The plurality of bin supports 158 are used to connect to the coupling feature 94 of the door liner 98 (see FIG. 1). In some aspects, the bin supports 158 may be nubs or support arms that slide into the coupling features 94 that may include, for example, cutouts or support bars. The structure of the bin supports 158 and corresponding coupling features 94 are not meant to be limiting and may include any structural features known by one skilled in the art. In some aspects, the one or more bin supports 158 are configured to couple the storage bin assembly 10 to one or more sets of coupling features 94 on the inner liner 98 of the refrigerator door 82. The top cover 38 includes the holding member 50 used to position the first magnetic member 46 used in the opening system disclosed herein.

Figure 4A:
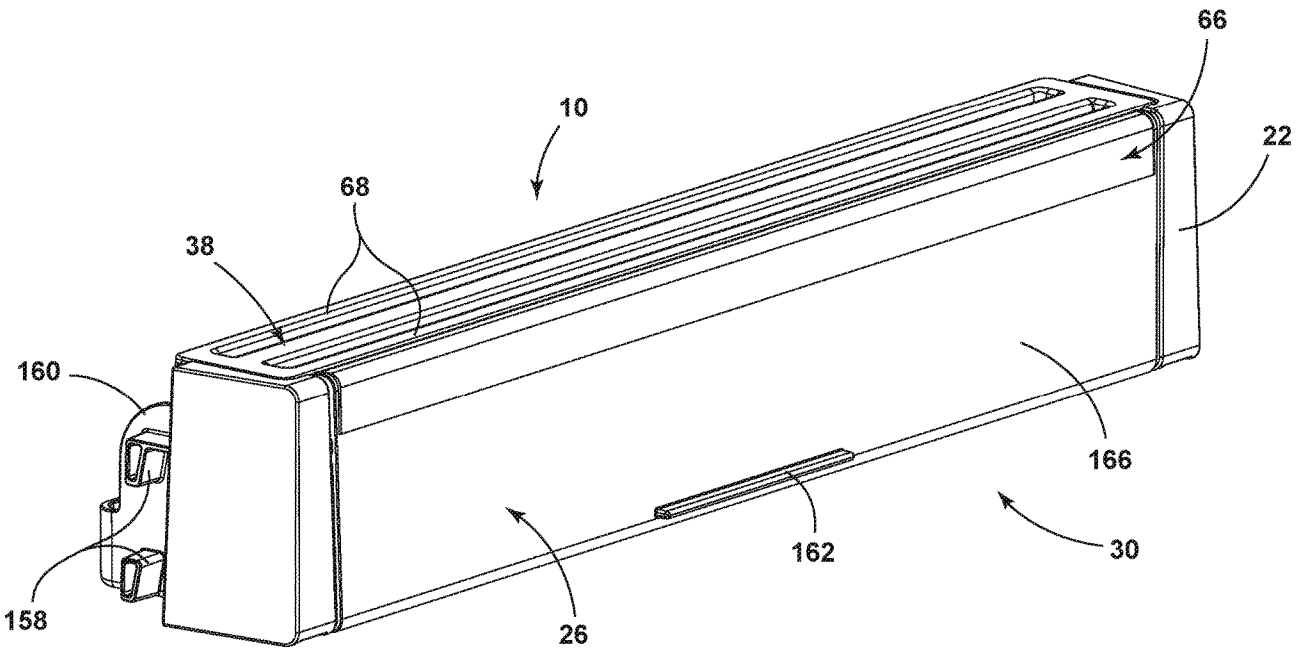
FIG. 4A is a front isometric view of a storage bin assembly in a closed position according to one aspect of the present disclosure.
Figure 4B:
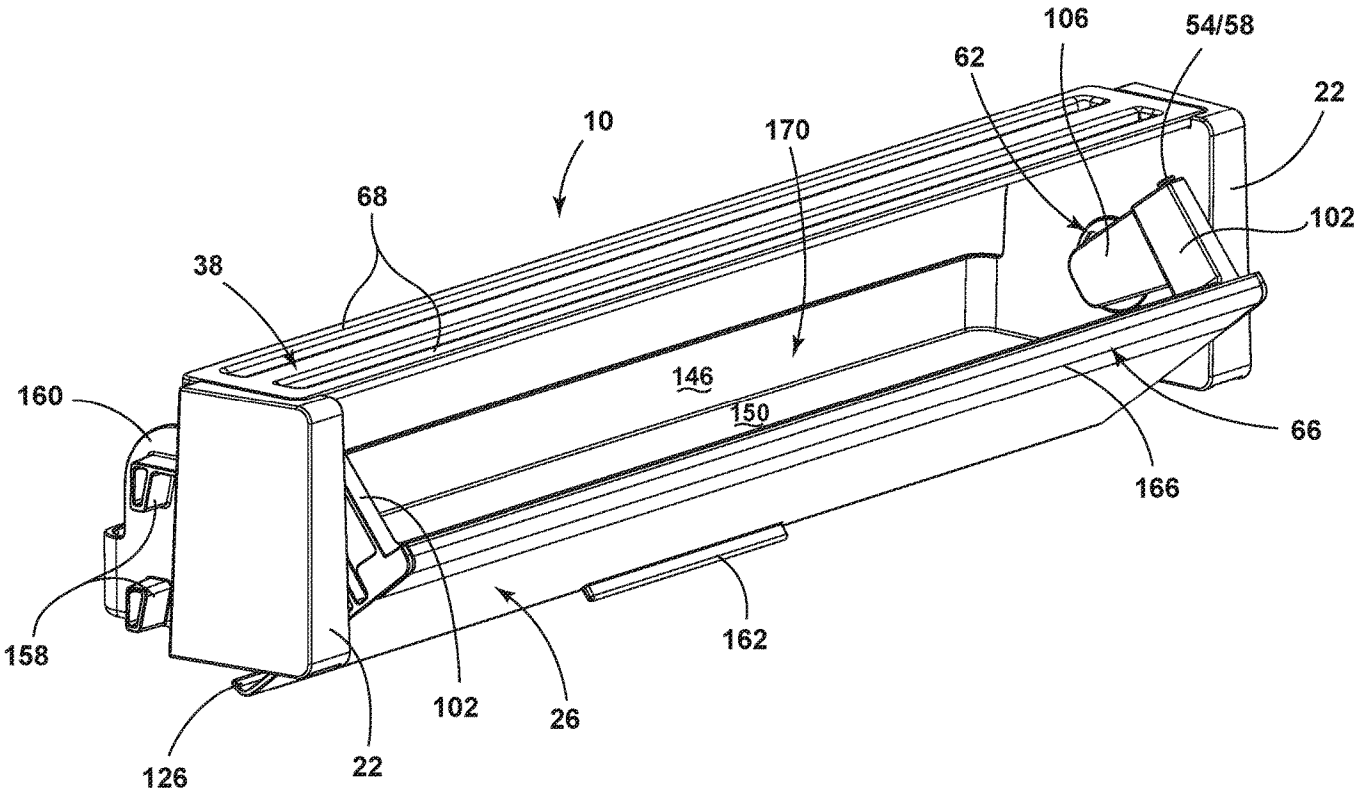
FIG. 4B is a front isometric view of the storage bin assembly provided in FIG. 3A in a partially open position according to one aspect of the present disclosure.
Figure 4C:
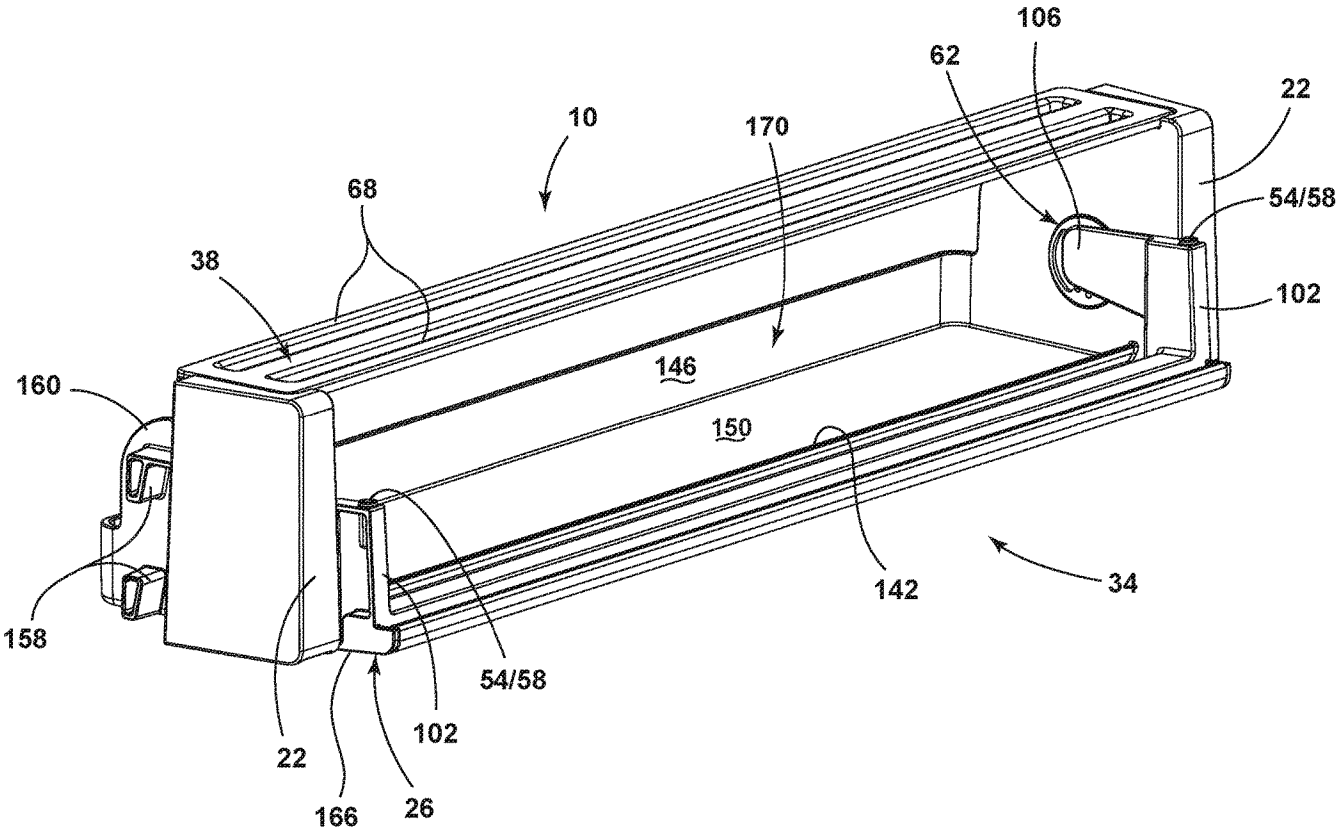
FIG. 4C is a front isometric view of the storage bin assembly provided in 3A in a fully open position according to one aspect of the present disclosure.

Referring now to FIGS. 4A-4C, the storage bin assembly 10 is provided in the closed position 30 (FIG. 4A), the partially open position (FIG. 4B), and the open position 34 (FIG. 4C). As illustrated, the flap 26 can be rotated between the upper closed and open positions 30, 34 using a handle 162 that the user can grip and rotate a front face 166 of the flap 26. As the flap 26 is rotated out of the upper closed position 30, the magnetic coupling force between the second magnetic member 54 and first magnetic member 46 is overcome and the front face 166 moves from a vertical position where the face 166 is pointing out towards the user to the open position 34 where the front face 166 is directed down towards the floor. Once the flap 26 of the storage bin assembly 10 is rotated to the partially open position or the fully open position 34, the user can access a bin storage space 170 enclosed by the outer end sidewalls 22, the top cover 38, the back wall 146, and the floor 150. In the fully open position 34, the magnetic coupling force or attraction between the second magnetic member 54 and first magnetic member 46 (see FIG. 3) is negligible and does not impact the flaps 26 movement.

In some aspects, the back wall 146 may have a height that completely or partially encloses the bin storage space 170. The dimensions of the storage bin assembly 10 may be varied depending on the size needed to couple the corresponding width and/or dimensions of the refrigerator and/or freezer door 82, 86. The length, width, and/or height of the storage bin assembly 10 can be varied or adjusted as would be appreciated by those skilled in the art.

Referring now to FIGS. 5A-5D, the opening assembly or opening system for the storage bin assembly 10 is emphasized in the illustrations. The second magnetic member 54 may be positioned in the receiving member 58 of the flap 26 while the first magnetic member 46 can be positioned in the holding member 50 of the top cover 38. The first and second magnetic members 46, 54 may individually be or both be a magnet and/or ferromagnetic material to form the magnetic connection used to close the storage bin assembly 10. The term "magnet", as used herein, is defined as a material or object that produces a magnetic field including permanent magnets. The term "ferromagnetic", as used herein, is used to describe a material or object that can either form a permanent magnet and/or is attracted to magnets. In some aspects, a permanent magnet can be used for both the second magnetic member 54 and the first magnetic member 46. In other aspects, the location and positioning of the second magnetic member 54 and first magnetic member 46 may be switched where the second magnetic member 54 can be positioned in the holding member 50 and the first magnetic member 46 can be positioned in the receiving member 58. Although the second magnetic member 54 is illustrated as a rod/cylinder, the shape of the second magnetic member 54 is not meant to be limiting since any shaped magnet can work in the disclosed opening system of the storage bin assembly 10 while the receiving member 58 can be alternatively designed to hold the respective second magnetic member 54. Although the first magnetic member 46 is illustrated as a plate/disk, the shape of the first magnetic member 46 is not meant to be limiting since any shaped ferromagnetic material can work in the disclosed opening system of the storage bin assembly 10 while the holding member 50 can be alternatively designed to hold the respective first magnetic member 46. In some aspects, the first magnetic member 46 and/or the second magnetic member 54 may be a neodymium magnet. In other aspects, the first magnetic member 46 and/or the second magnetic member 54 may include or may be made from iron, alnico, bismanol, cobalt, nickel, chromium (IV) oxide, dysprosium, ferrite, gallium manganese arsenide, KS steel, sintered barium ferrite, MKM steel, permalloy, samarium-cobalt, suessite, and combinations thereof.

Figure 5A:
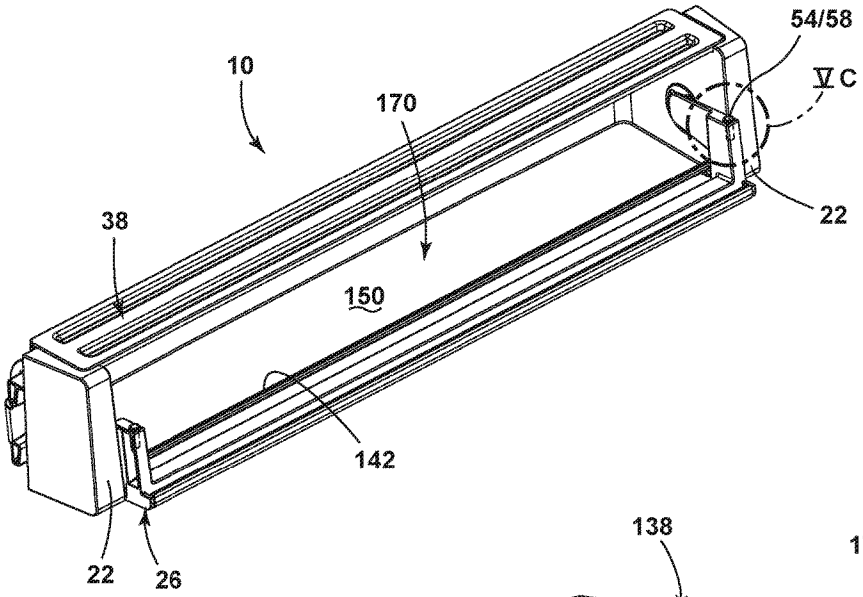
FIGS. 5A-5B are front isometric views of the storage bin assembly provided in FIG. 3 in the open and the closed position showing a magnet closing assembly according to some aspects of the present disclosure.
Figure 5B:
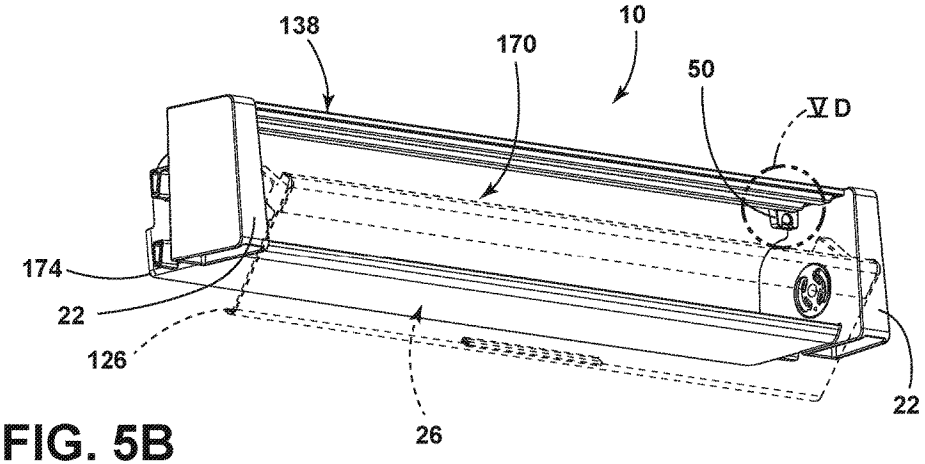
Figure 5C:
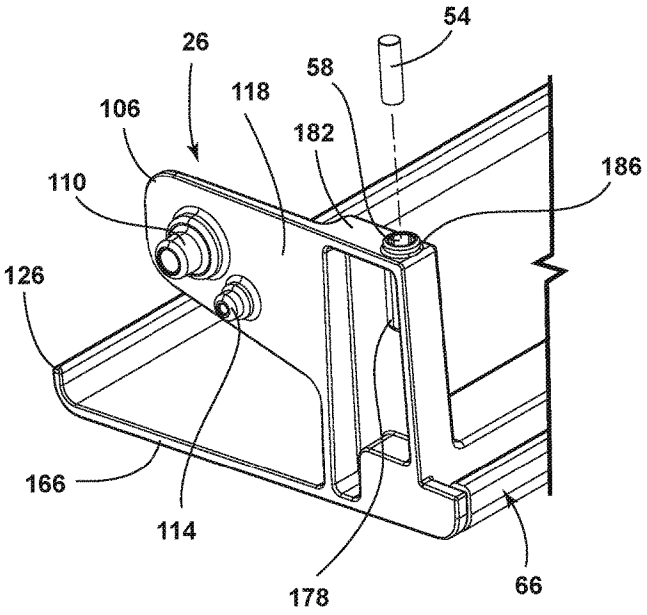
FIG. 5C is a partially schematic fragmentary view of a lid of the storage bin assembly taken at location VC in FIG. 5A.

Referring now to FIG. 5C, the second magnetic member 54 may be positioned in the receiving member 58 where the receiving member 58 may include a receiving member wall 178 that can fully enclose the second magnetic member 54 on all of the member's 54 sides except for an exposed side/surface that can be in direct contact with the first magnetic member 46. An arm contact surface 182 is configured to contact a holding member contact wall 194 (see FIG. 5D) where the two respective surfaces rest flat against each other in the closed position 30 to impart stability.

Figure 5D:
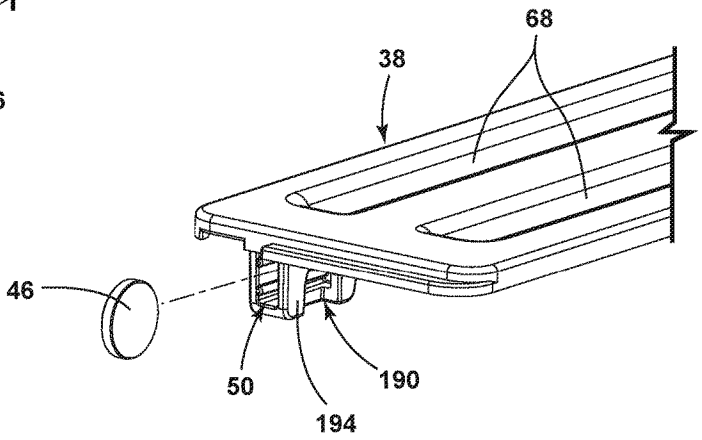
FIG. 5D is a partially schematic fragmentary view of a top cover of the storage bin assembly taken at location VD of FIG. 5B.

Referring now to FIG. 5D, the first magnetic member 46 may be positioned in the holding member 50 where the holding member 50 may include a recess 190 and the holding member contact wall 194. When the flap 26 is positioned in the upper closed position 30, the exposed surface or side of the first magnetic member 46 may be positioned in the recess 190 of the holding member 50 so the second magnetic member 54 can be in direct contact with the first magnetic member 46. As illustrated, an exposed portion of the first magnetic member 46 is provided based on the design of the holding member 50.

As the user operates the opening assembly/system of the storage bin assembly 10, the user may feel a snapping sensation or click as the flap 26 is positioned or closed to the upper closed position 30 and the magnetic connection is formed with the first and second magnetic members 46, 54. Likewise, as the flap 26 is opened, the user will feel a release sensation as the magnetic attraction or magnetic connection between the first magnetic member 46 and second magnetic member 54 dissipates with increasing distance. The strength of the magnetic attraction or magnetic connection between the first magnetic member 46 and second magnetic member 54 can be adjusted as desired depending on the preferred feeling and force required to open the flap 26 of the storage bin assembly 10. In some aspects, a variety of different magnetic materials may be used to customize the feel of the opening/closing assembly system.

In some aspects, at least one of the second magnetic member 54 and the first magnetic member 46 may include a polymeric cover used to completely enclose/surround and protect the metal surfaces of the respective second magnetic member 54 and/or first magnetic member 46 from oxidation or other decomposition reactions on the surface of the metal surfaces. In some aspects, both the second magnetic member 54 and the first magnetic member 46 may include a polymeric cover. In some aspects, the polymeric cover may include, for example, a polyester, an acrylonitrile butadiene styrene (ABS) copolymer, a polyoxymethylene, a polyamide, a polycarbonate, a polyethylene, a polypropylene, a polyacrylate, or any other thermoplastic and/or thermoset material known in the art. In addition to the polymeric cover preventing corrosion phenomenon, the polymeric cover may additionally be used to reduce noise in the opening assembly/system and/or improve aesthetics of the storage bin assembly 10. The thickness of the polymeric cover used on the first magnetic member 46 and/or second magnetic member 54 may be from about 0.01 mm to about 5.0 mm, from about 0.01 mm to about 1.0 mm, from about 0.1 mm to about 1.5 mm, or from about 0.1 mm to about 1.0 mm.

The opening assembly/system of the storage bin assembly 10 may not necessarily be limited to a cylindrical second magnetic member 54 positioned in the receiving member 58 used to directly contact the first magnetic member 46 positioned in the holding member 50. As previously discussed, the shape of the respective first magnetic member 46 and second magnetic member 54 may be varied to include any shape and at least one of respective first magnetic member 46 and second magnetic member 54 may be a permanent magnet. In some aspects, the first magnetic member 46 and second magnetic member 54 may be used in combination to form and incorporate a magnetic latch, a magnetic catch, a magnetic strip, a magnetic hinge, and/or a magnetic spring to form the magnetic connection. In other aspects, the use of at least one of the first magnetic member 46 and second magnetic member 54 may include applying an electrical current to form an electromagnet. In these aspects, the application of current to produce a magnetic field in the first magnetic member 46 and/or second magnetic member 54 may be controlled or activated/deactivated by the handle 162 or other switching mechanism. The opening assembly/system of the storage bin assembly 10 disclosed herein may use any type of magnetic system or mechanism to facilitate rotation of the flap 26 between the closed and open positions 30, 34 where the upper closed position 30 uses the respective magnetic assembly to quietly close and immobilize the flap 26 of the storage bin assembly 10 using the magnetic connection.

Figure 6A:
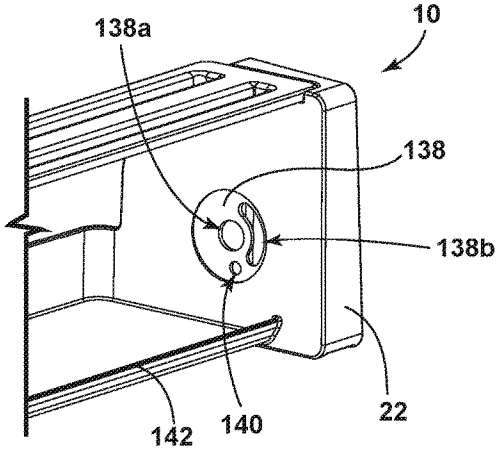
FIGS. 6A-6C are partially schematic fragmentary views of a bumper insert placed in the outer end sidewalls of the storage bin assembly according to some aspects of the present disclosure.
Figure 6B:
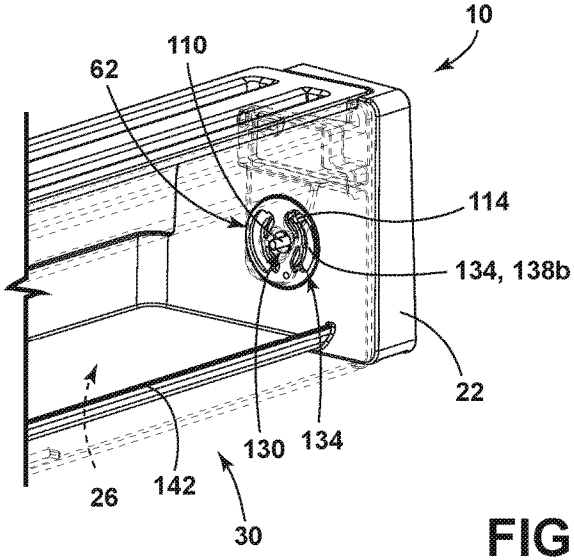
Figure 6C:
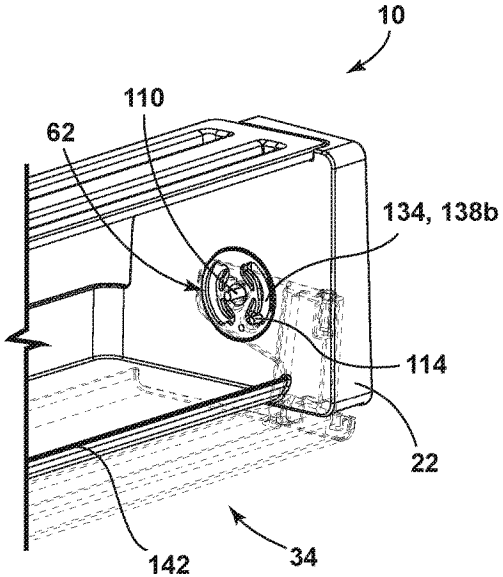

Referring now to FIGS. 6A-6C, the bumper insert 62 is shown positioned in the rotational guide 138 of the outer end sidewalls 22 of the base portion. The rotational guide 138 includes the center guide 138*a*, the rotational guide 138*b*, and the sidewall locking guide 140. The bumper insert 62 is operatively coupled to the rotational guide 138 by inserting the center cutout tab 62*a* (see FIG. 3) into the center guide 138*a*, the bumper insert positioning tab 62*b* (see FIG. 3) into the sidewall locking guide 140, where the rotational cutout 134 is aligned with the sidewall rotational guide 138*b*. The pivot member 110 and boss 114 of the flap 26 are operatively coupled to the features mentioned above in both the bumper insert 62 and rotational guide 138. The pivot member 110 and the boss 114 are respectively positioned in the center cutout 130 and the rotational cutout 134, respectively, of the bumper insert 62. The flap 26 can then be rotated using the pivot member 110 as the positioning element locking the flap 26 in a single axial position while the boss 114 is rotationally guided through both the rotational cutout 134 and the sidewall rotational guide 138*b*. When the storage bin assembly 10 is in the closed position 30, the boss 114 is rotated up to the top of the rotational cutout 134 and rotational guide 138*b*. When the storage bin assembly 10 is in the open position 34, the boss 114 is rotated down to the bottom of the rotational cutout 134 and rotational guide 138*b*.

The base portion 18, the flap 26, top cover 38, and/or bumper insert 62, and/or other components described herein may be formed through injection molding, compression molding, rotation molding, thermoforming, curing, and casting. The base portion 18, the flap 26, top cover 38, and/or bumper insert 62, and/or other components may include any thermoplastic, thermoset, or a combination thereof of materials known in the art. The method of manufacturing the respective components of the storage bin assembly 10 and the corresponding materials used to form them are not meant to be limiting and can be varied in ways that would be appreciated by those skilled in the art.

Figure 7:
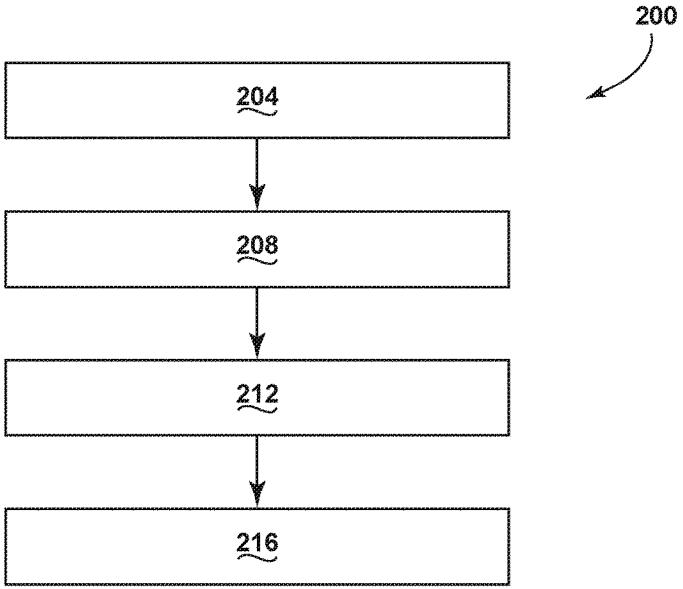
FIG. 7 is a flow diagram of a method for making a storage bin assembly having a magnetic closure system according to some aspects of the present disclosure.

Referring now to FIG. 7, with continued reference to FIGS. 1-6C, a method 200 for making the storage bin assembly 10 is shown. The method 200 may begin with a step 204 that includes providing the base portion 18 having opposed outer end sidewalls 22 upwardly extending from the base portion 18. The base portion 18 may include the lip 142 opposing the back wall 146 that together in combination with the outer end sidewalls 22 frame in the floor 150 of the base portion 18.

Next is a step 208 of pivotably coupling the flap 26 to the opposed outer end sidewalls 22 where the flap 26 is configured to rotate between the upper closed portion 30 and the open position 34 where the flap 26 is positioned beneath the base portion 18. The flap 26 may be designed to include the edge portion 120 used to couple the profile buffer strip 66 using the clip member 122 formed onto the profile buffer strip 66. On the opposite end of the flap 26, the curved flange member 126 may be positioned along the length of a bottom edge of the flap 26. In some aspects, the curved flange member 126 may be used in the upper closed and/or open positions 30, 34 to help stabilize the flap 26 by helping eliminate twisting or lateral movement.

Next is a step 212 of positioning the top cover 38 onto the receiving slot portion 42 of the opposing outer end sidewalls 22 where the first magnetic member 46 is positioned in the holding member 50 of the top cover 38. The two outer end sidewalls 22 include the receiving slot portion 42 configured to position the top cover 34 therein so both the top portions of the top cover 34 and outer end sidewalls 22 are level with each other to form a flat top surface on the top cover 38 for the storage bin member 10. In some aspects, the top cover 38 may include one or more ridges 68 molded or carved into the top portion. In such aspects, the one or more ridges 68 may form a textured surface to grip foodstuffs positioned on the top portion of the top cover 38.

Next is a step 216 of positioning the second magnetic member 54 in the receiving member 58 of the flap 26. The enclosed first magnetic member 46 and second magnetic member 54 are used to form an opening/closing assembly or system used to close the flap 26 of the storage bin assembly 10 to be in contact with a rear portion 100 of the top cover 38. In some aspects the second magnetic member 54 and the first magnetic member 46 may include a polymeric cover used to completely enclose/surround and protect the metal surfaces of the respective second magnetic member 54 and/or first magnetic member 46 from oxidation or other decomposition reactions on the surface of the metal surfaces. The polymeric cover may additionally be used to give a soft feel to the snapping shut of the flap 26 in the closed position 30.

It is understood that the descriptions outlining and teaching the storage bin assembly 10 previously discussed, which can be used in any combination, apply equally well to the method 200 for producing the storage bin assembly 10.

In some aspects, the descriptions outlining and teaching the storage bin assembly 10 previously discussed, which can be used in any combination, may be applied so the storage bin assembly 10 may be used in the refrigerator door 82, the freezer door 86, and/or the refrigerator 14. When the storage bin assembly 10 is incorporated onto or in the refrigerator door 82, the refrigerator door 82 may include the door liner 98 disposed on an inner portion of the door 82, the liner 98 including opposed outwardly extending sidewalls that are spaced apart from one another, having outwardly extending or inwardly extending coupling features disposed on inner surfaces of each opposed sidewall. When the storage bin assembly 10 is more broadly incorporated onto or in the refrigerator 14, the refrigerator 14 may include the refrigerator door 82 where the refrigerator door 82 includes the door liner 98 disposed on an inner portion of the door 82, the liner 98 including opposed outwardly extending sidewalls that are spaced apart from one another, having outwardly extending or inwardly extending coupling features disposed on inner surfaces of each opposed sidewall.

The storage bin assembly 10 provides a number of benefits, including ergonomic benefits, to users. For example, the flap 26 and magnetic connection are configured to quietly and securely rotate the flap 26 between the closed position 30 and the open position 34. As the user initiates opening the flap 26, the user will feel a release sensation as the magnetic connection between the second magnetic member 54 and first magnetic member 46 dissipates. Upon closing, the user will feel a snapping or clicking sensation as the flap 26 is positioned or closed to the upper closed position 30. The magnetic connection between the second magnetic member 54 of the flap 26 and first magnetic member 46 positioned in one or more different positions on the storage bin assembly 10 provides the user with the ability to position the flap 26 between the closed position 30 and open position 34 in a quieter, faster, more efficient, and more ergonomic manner or means than what is currently used in the art.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

LIST OF NON-LIMITING EMBODIMENTS

Embodiment A is a storage bin assembly for a refrigerator comprising: a base portion having opposed outer end sidewalls upwardly extending from the base portion; a flap pivotably coupled to the opposed outer end sidewalls wherein the flap is configured to rotate between a closed position and an open position where the flap is positioned beneath the base portion; a top cover coupled to a receiving slot portion of the opposed outer end sidewalls wherein a first magnetic member is positioned in a holding member proximate the top cover; and a second magnetic member positioned in a receiving member of the flap that selectively engages the first magnetic member to define a magnetic connection.

The storage bin assembly of Embodiment A wherein a bumper insert positioned in each of the opposed outer end sidewalls wherein the bumper insert includes a rotational cutout used to direct rotation of the flap.

The storage bin assembly of Embodiment A or Embodiment A with any of the intervening features wherein a profile strip configured to cover an edge portion of the flap to form a seal against the base portion and top cover when the flap is in the closed position.

The storage bin assembly of Embodiment A or Embodiment A with any of the intervening features wherein the holding member is coupled to the top cover, the opposed outer end sidewalls, a lip, a back wall, a floor, or a combination thereof.

The storage bin assembly of Embodiment A or Embodiment A with any of the intervening features wherein at least one of the first magnetic member and the second magnetic member comprise a polymeric coating.

The storage bin assembly of Embodiment A or Embodiment A with any of the intervening features wherein at least one of the first magnetic member and the second magnetic member is a neodymium magnet.

The storage bin assembly of Embodiment A or Embodiment A with any of the intervening features wherein the flap and magnetic connection are configured to quietly and securely rotate the flap between the closed position and the open position.

Embodiment B is a refrigerator door comprising: a liner disposed on an inner portion of the door, the liner including opposed outwardly extending sidewalls that are spaced apart from one another, having outwardly extending coupling features disposed on inner surfaces of each opposed sidewall; and a storage bin assembly comprising: a base portion having opposed outer end sidewalls upwardly extending from the base portion; a flap pivotably coupled to the opposed outer end sidewalls wherein the flap is configured to rotate between a closed position and an open position where the flap is positioned beneath the base portion; a top cover coupled to a receiving slot portion of the opposed outer end sidewalls wherein a first magnetic member is positioned in a holding member proximate the top cover; and a second magnetic member positioned in a receiving member of the flap that selectively engages the first magnetic member to define a magnetic connection.

The refrigerator door of Embodiment B wherein a bumper is positioned in each of the opposed outer end sidewalls wherein the bumpers have a rotational cutout used to direct rotation of the flap.

The refrigerator door of Embodiment B or Embodiment B with any of the intervening features wherein a profile strip configured to cover an edge portion of the flap to form a seal against the base portion and top cover when the flap is in the closed position.

The refrigerator door of Embodiment B or Embodiment B with any of the intervening features wherein the holding member is coupled to the top cover, the opposed outer end sidewalls, a lip, a back wall, a floor, or a combination thereof.

The refrigerator door of Embodiment B or Embodiment B with any of the intervening features wherein at least one of the first magnetic member and the second magnetic member comprise a polymeric coating.

The refrigerator door of Embodiment B or Embodiment B with any of the intervening features wherein at least one of the first magnetic member and the second magnetic member is a neodymium magnet.

The refrigerator door of Embodiment B or Embodiment B with any of the intervening features wherein the flap and magnetic connection are configured to quietly and securely rotate the flap between the closed position and the open position.

Embodiment C is a refrigerator comprising: a door; a liner disposed on an inner portion of the door, the liner including opposed outwardly extending sidewalls that are spaced apart from one another, having outwardly extending coupling features disposed on inner surfaces of each opposed sidewall; and a storage bin assembly comprising: a base portion having opposed outer end sidewalls upwardly extending from the base portion; a flap pivotably coupled to the opposed outer end sidewalls wherein the flap is configured to rotate between a closed position and an open position where the flap is positioned beneath the base portion; a top cover coupled to a receiving slot portion of the opposed outer end sidewalls wherein a first magnetic member is positioned in a holding member proximate the top cover; and a second magnetic member positioned in a receiving member of the flap that selectively engages the first magnetic member to define a magnetic connection.

The refrigerator of Embodiment C wherein the storage bin assembly further comprises: a bumper insert positioned in each of the opposed outer end sidewalls wherein the bumper insert includes a rotational cutout used to direct rotation of the flap.

The refrigerator of Embodiment C or Embodiment C with any of the intervening features wherein the storage bin assembly further comprises: a profile strip configured to cover an edge portion of the flap to form a seal against the base portion and top cover when the flap is in the closed position.

The refrigerator of Embodiment C or Embodiment C with any of the intervening features wherein the flap and magnetic connection are configured to quietly and securely rotate the flap between the closed position and the open position.

The refrigerator of Embodiment C or Embodiment C with any of the intervening features wherein at least one of the first magnetic member and the second magnetic member comprise a polymeric coating.

The refrigerator of Embodiment C or Embodiment C with any of the intervening features wherein at least one of the first magnetic member and the second magnetic member is a neodymium magnet.

What is claimed is:

1. A storage bin assembly for a refrigerator comprising:

a base portion having opposed first and second outer end sidewalls upwardly extending from the base portion to define a storage space therebetween;

a flap having a front face and an inner surface and first and second hinge arms outwardly extending from the inner surface of the flap, wherein one of the first hinge arm and the second hinge arm includes a receiving member, and further wherein the first and second hinge arms further include first and second arm flaps, respectively, extending orthogonally from the first and second hinge arms, wherein the first and second arm flaps are pivotally coupled to the first and the second outer end sidewalls, respectively, such that the flap rotates between open and closed positions relative to the storage space, wherein the flap is positioned beneath the base portion when the flap is in the open position;

a top cover coupled to a receiving slot portion of the first and the second outer end sidewalls, wherein the top cover includes a holding member extending outwardly from an inner surface of the top cover;

a first magnetic member received in the holding member; and a second magnetic member positioned in the receiving member to selectively engage the first magnetic member to define a magnetic connection therebetween when the flap is in the closed position.

2. The storage bin assembly of claim 1, further comprising:

a first bumper insert positioned between the first outer end sidewall and the first arm flap;

a second bumper insert positioned between the second outer end sidewall and the second arm flap, wherein the first and the second bumper inserts include rotational cutouts in which first and second bosses of the first and the second arm flap are received respectively, to direct rotation of the flap.

3. The storage bin assembly of claim 2, wherein the first and the second outer end sidewalls further include rotational guides in which the first and the second bosses of the first and the second arm flap are received, respectively.

4. The storage bin assembly of claim 3, wherein the rotational guide and the rotational cutouts are aligned with one another.

5. The storage bin assembly of claim 1, further comprising:

a profile strip configured to cover an edge portion of the flap to form a seal against the base portion and the top cover when the flap is in the closed position.

6. The storage bin assembly for a refrigerator of claim 1, wherein one of the first opposed outer end sidewall and the second opposed outer end sidewall includes a sidewall locking guide.

7. A refrigerator door comprising:

a liner disposed on an inner portion of the door, the liner including opposed outwardly extending sidewalls that are spaced apart from one another, having outwardly extending coupling features disposed on inner surfaces of each of the opposed outwardly extending sidewalls; and a storage bin assembly comprising:

a base portion having opposed outer end sidewalls upwardly extending from the base portion, wherein the opposed outer end sidewalls include rotational guides disposed therethrough;

a flap pivotally coupled to the opposed outer end sidewalls, wherein the flap includes outwardly extending bosses received in the rotational guides to guide rotation of the flap between a closed position and an open position where the flap is positioned beneath the base portion;

a top cover coupled to a receiving slot portion of the opposed outer end sidewalls wherein a first magnetic member is positioned in a holding member proximate the top cover;

a second magnetic member positioned in a receiving member of the flap that selectively engages the first magnetic member to define a magnetic connection;

at least one hinge arm coupled to the flap; and an arm flap extending orthogonally from the at least one hinge arm and pivotally coupled to the opposed outer end sidewalls.

8. The refrigerator door of claim 7, wherein the storage bin assembly further comprises:

a bumper positioned in each of the opposed outer end sidewalls, wherein the bumper has a rotational cutout used to direct rotation of the flap; and a bumper insert positioning tab coupled to the rotational guide.

9. The refrigerator door of claim 8, wherein the rotational guides and the rotational cutouts are aligned with one another.

10. The refrigerator door of claim 7, wherein the storage bin assembly further comprises:

a profile strip configured to cover an edge portion of the flap to form a seal against the base portion and the top cover when the flap is in the closed position.

11. The refrigerator door of claim 7, wherein the arm flap includes a pivot member outwardly extending therefrom.

12. The refrigerator door of claim 7, wherein the storage bin assembly includes a curved flange member positioned along a bottom edge of the flap.

13. A refrigerator comprising:

a door;

a liner disposed on an inner portion of the door, the liner including opposed outwardly extending sidewalls that are spaced apart from one another, having outwardly extending coupling features disposed on inner surfaces of each of the opposed outwardly extending sidewalls; and a storage bin assembly comprising:

a base portion having opposed outer end sidewalls upwardly extending from the base portion to define a storage space therebetween;

a flap having a front face and an inner surface and a hinge arm outwardly extending from the inner surface of the flap, wherein the hinge arm includes a receiving member, and further wherein the hinge arm further includes an arm flap extending orthogonally from the hinge arm, wherein the arm flap is pivotally coupled to the opposed outer end sidewalls such that the flap rotates between open and closed positions relative to the storage space, wherein the flap is positioned beneath the base portion when the flap is in the open position;

a top cover coupled to a receiving slot portion of the opposed outer end sidewalls, wherein the top cover includes a holding member extending outwardly from an inner surface of the top cover;

a first magnetic member received in the holding member; and a second magnetic member positioned in the receiving member to selectively engage the first magnetic member to define a magnetic connection therebetween when the flap is in the closed position.

14. The refrigerator of claim 13, wherein the storage bin assembly further comprises:

a bumper insert positioned between the opposed outer end sidewalls and the arm flap, wherein the bumper insert includes a rotational cutout in which bosses of the arm flap are received to direct rotation of the flap.

15. The refrigerator of claim 14, wherein a rotational guide is aligned with the rotational cutout of the bumper insert.

16. The refrigerator of claim 13, wherein the storage bin assembly further comprises:

a profile strip configured to cover an edge portion of the flap to form a seal against the base portion and the top cover when the flap is in the closed position.

17. The refrigerator of claim 13, wherein the flap includes a curved flange member.

* * * * *